US006244678B1

(12) United States Patent
Dopp et al.

(10) Patent No.: US 6,244,678 B1
(45) Date of Patent: Jun. 12, 2001

(54) DRAWER SLIDE WITH FRONT-MOUNTED STOP/ANTI-REBOUND MECHANISM

(75) Inventors: Alex Dopp, Grandville, MI (US); Herman T. Smeets, Kingman, AZ (US); Alan R. Wright, Wyoming, MI (US)

(73) Assignee: Thomas Regout USA, Inc., Byron Center, MI (US)

( * ) Notice: Subject to any disclaimer, the term of this patent is extended or adjusted under 35 U.S.C. 154(b) by 0 days.

(21) Appl. No.: 09/392,176

(22) Filed: Sep. 9, 1999

(51) Int. Cl.[7] ..... A47B 88/04
(52) U.S. Cl. ..... 312/333; 312/334.44
(58) Field of Search ..... 312/334.1, 334.46, 312/334.47, 334.44, 333, 330.1; 384/18, 21, 22

(56) References Cited

U.S. PATENT DOCUMENTS 4,469,384 * 9/1984 Fler et al. ..... 312/334.11 X
4,537,450 * 8/1985 Baxter ..... 384/18
4,932,792 6/1990 Baxter ..... 384/18
5,181,782 * 1/1993 Wojcik ..... 312/334.44 X
5,466,060 * 11/1995 Hoffman ..... 312/334.44 X

* cited by examiner

*Primary Examiner*—Peter M. Cuomo
*Assistant Examiner*—James O. Hansen
(74) *Attorney, Agent, or Firm*—Warner Norcross & Judd LLP

(57) ABSTRACT

An integrated anti-rebound mechanism with stop feature for a rail assembly. Two stop/anti-rebound pieces are individually attached at the forward end of a first rail and a second rail of the rail assembly. The stop/anti-rebound pieces engage one another when the first and second rails are in a closed position to prevent the first and second rails from moving beyond a closed position from an extended position. The stop/anti-rebound pieces also cooperate to resist movement of the first and second rails from a closed position. A third rail may be included in the rail assembly including a stop mechanism and an anti-rebound mechanism. The stop and anti-rebound mechanisms cooperate with on of the stop/anti-rebound pieces of the other rail to prevent the third rail from moving beyond a closed position, and to resist movement of the third rail from a closed position in relation to the other rail.

9 Claims, 4 Drawing Sheets

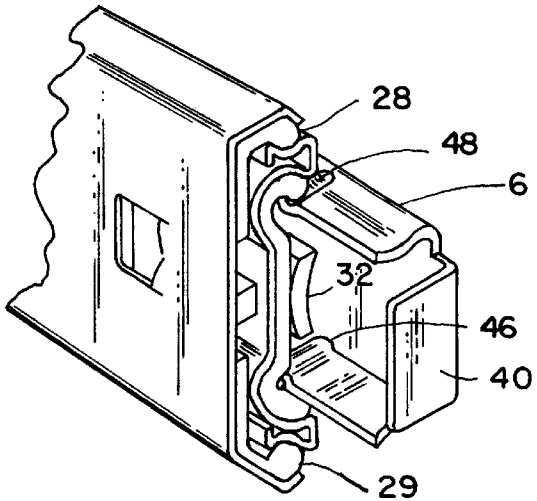
FIG. 2
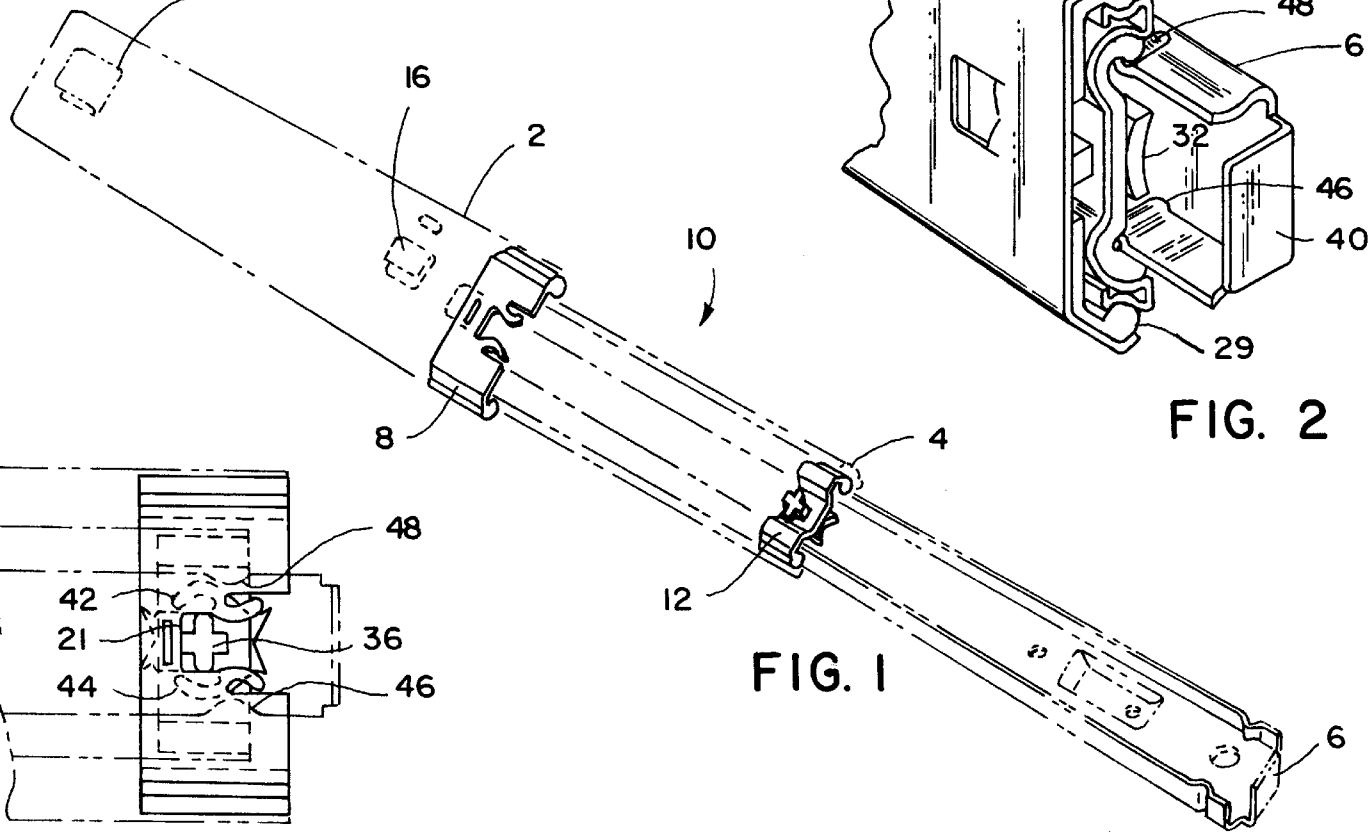
FIG. 1
FIG. 3

DRAWER SLIDE WITH FRONT-MOUNTED STOP/ANTI-REBOUND MECHANISM

BACKGROUND OF THE INVENTION

The present invention relates to drawer slides and, more particularly, to drawer slides having anti-rebound mechanisms for preventing a closed drawer from rebounding to a partially open position.

Drawer slides are routinely used to mount drawers within cabinets. The slides enable the drawer to be pulled out from the cabinet so that items in the drawer may be easily accessed. The slide typically includes two three quarter extension or three full extension rails slidably interfitted within one another, with one of the rails attached to the cabinet and one of the rails attached to the drawer. The slide includes a stop mechanism to stop the closing or opening movement of the rails and often also includes an anti-rebound mechanism to prevent the drawer from bouncing to a partially open position.

When included, the typical anti-rebound mechanism is located at the rear of the rail assembly, at the back of the cabinet, where maintenance and replacement are hindered. For example, one anti-rebound device for drawer slides is illustrated in U.S. Pat. No. 4,932,792 issued Jun. 12, 1990 to Baxter and includes an anti-rebound member attached to the rear end of the cabinet rail. As the drawer rail moves to the closed position, the anti-rebound member grasps the drawer rail to resist both closure and reopening. The positioning of the anti-rebound device at the rear portion of the rail assembly makes it difficult to perform maintenance on the anti-rebound mechanism; such positioning also necessitates using a cabinet rail that is of substantial length to spatially accommodate the long anti-rebound mechanism.

SUMMARY OF THE INVENTION

The aforementioned problems are overcome by the present invention wherein both the stop function and the anti-rebound function are provided by a common set of pieces located at the front of the drawer slide assembly.

More specifically, a first piece of the stop/anti-rebound mechanism is mounted on the front end of the cabinet rail. A second piece of the stop/anti-rebound mechanism is mounted on the front end of the intermediate rail. The two pieces frictionally interlock to prevent rebound of the intermediate rail from the closed position. The drawer rail includes detents that frictionally interlock with the second piece to prevent rebound of the drawer rail from the closed position. Both pieces can be easily accessed for service or replacement. The pieces also provide the stop functions for the interfitting rails.

In an alternative embodiment, a three quarter extension slide includes only two rails (i.e. no intermediate rail); and only one stop/anti-rebound piece is included. The anti-rebound piece is mounted on the front end of the drawer rail and operates similarly to the second piece of the previously described embodiment.

Thus, in both two and three rail assemblies, the anti-rebound mechanism and a stop feature are combined in one assembly and are mounted at the front end of the slide to be easily accessible for maintenance. Further, because the anti-rebound mechanism is mounted at the front of the rail assembly, the cabinet rail of the present invention can be up to 50% shorter in length than conventional cabinet rails with rear mounted anti-rebound mechanisms.

These and other objects, advantages, and features of the invention will be more readily understood and appreciated by reference to the detailed description of the preferred embodiment and the drawings.

BRIEF DESCRIPTION OF THE DRAWINGS

FIG. 1 is a perspective view of the fully extended slide with the rails shown in phantom;

FIG. 2 is a perspective view of the front of the slide with the drawer rail partially withdrawn from the intermediate rail;

FIG. 3 is a side elevation view of the anti-rebound mechanism with the rails shown in phantom and in the FIG. 2 position;

DETAILED DESCRIPTION OF THE PREFERRED EMBODIMENT

Figure 4:
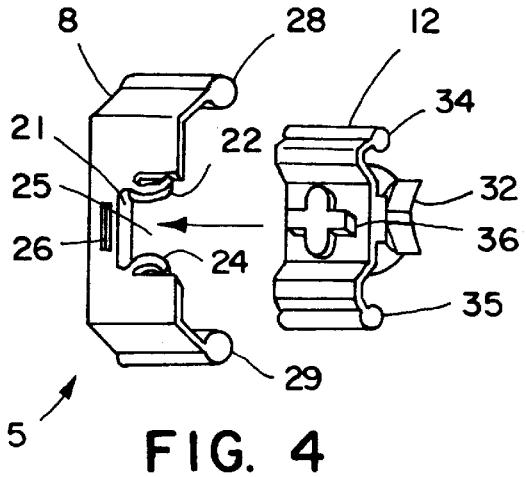
FIG. 4. is a perspective view of the anti-rebound mechanism.
Figure 5:
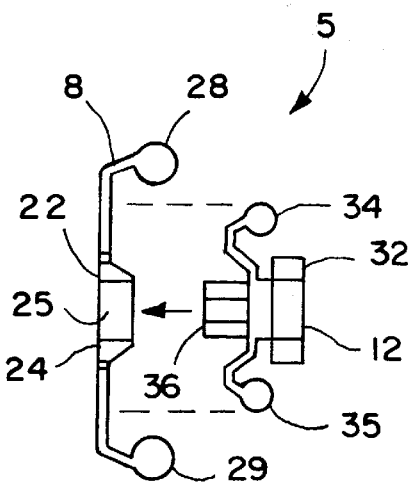
FIG. 5 is an end view of the anti-rebound mechanism.

A drawer slide or rail assembly according to a preferred embodiment of the present invention is illustrated in the drawings and generally designated 10. The rail assembly includes three rails 2, 4, 6 which cooperatively slide within respect to one another. The illustrated embodiment is intended for use in a conventional lateral filing cabinet. However, the present invention is readily adaptable to a wide variety of slides for a variety of applications. It will be readily apparent to those skilled in the art that the rail assembly in the figure only represents one side of a complete rail assembly system in a cabinet, and that a complete rail assembly system would include a mirror set of rails on the left and right sides of a cabinet. One mirror set of rails may or may not include an anti-rebound device with stop feature, depending on the application. The terms "forward" and "rearward" will be used in this disclosure to denote directions toward the front or back, respectively, of the rail assembly when the rail assembly is in normal use within a cabinet.

In general, the rail assembly 10 supports a drawer (not shown) within a cabinet (not shown) to allow the drawer (not shown) to be withdrawn from the cabinet. The rail assembly includes an anti-rebound mechanism with stop mechanism 5 including two separate pieces or members 8, 12.

Figure 12:
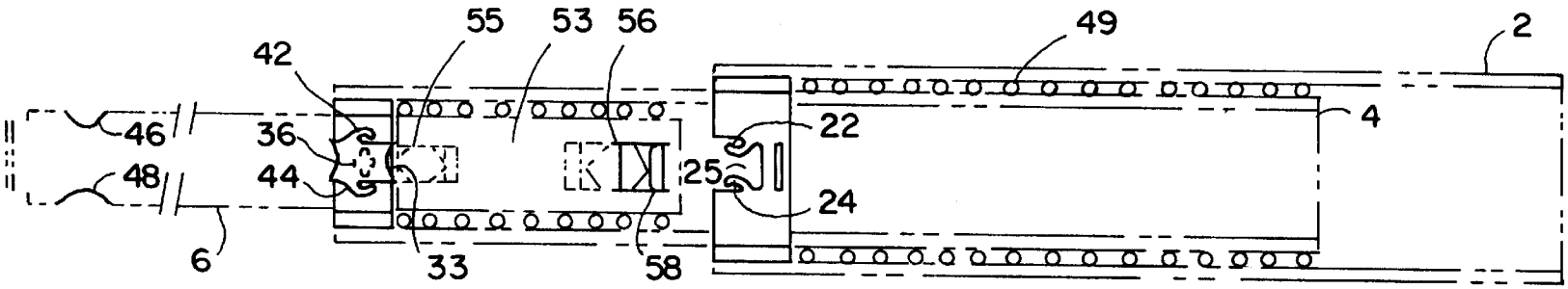
FIG. 12 is a plan view of the slide with the intermediate rail fully extended and the drawer rail fully extended.

The rails 2, 4, 6 are generally conventional and therefore will not be described in detail. Each rail includes a cabinet member 2, an intermediate member 4, telescopically received within the cabinet member 2, and a drawer member 6, telescopically received within the intermediate member 4 (see FIG. 1.) Conventional bearings 49, bushings or other similar elements are located between the rails to provide smooth and easy extension and retraction of the rails. In particular, the bearing cages 51 and 53 and their internal bumpers, 52 and 50, 56 and 55, (as seen in FIGS. 12 and 13) are also known in the art, and will not be described in detail. The cabinet member 2 includes two mounting tabs 14 and 16 that are fixedly received in a conventional manner within fingered tabs or slots located on the inside of the cabinet (not shown). The drawer (not shown) is attached to the drawer rail 6 by conventional means, such as bolts, screws, or rivets.

The anti-rebound mechanism pieces or members 8 and 12 fit into the cabinet rail and intermediate rail, respectively as shown in FIG. 2. FIGS. 2 and 3 depict the detents 46, 48 on the drawer rail 6 which effectively depress detent prongs 18 and 20 so that the drawer rail is locked in a fully closed position after it slides over the detent prongs 18, 20 when the rail assembly is moved to a closed position.

Bumper 32 is positioned on the second anti-rebound member so that it protrudes partially into the channel on the interior of the drawer rail 6 and cooperates with the drawer rail stop tab 40 to absorb some of the force generated by closure of the drawer rail 6. FIG. 3 further depicts the cabinet rail 2 and the intermediate rail 4 in a closed position wherein the first anti-rebound member 8 has received the second anti-rebound member 12 and holds it in a closed position such that the intermediate rail 4 may not rebound back to an open position after being forcefully closed.

As can be seen in FIG. 4, the first member 8 includes two homing cylinders 28, 29 that are received within the bearing raceways of the cabinet rail 2. The holding tab slot 26 provides an aperture through which the holding tab 38 which forms part of the cabinet rail 2 may hold in place the first anti-rebound member 8 (depicted in FIG. 6). The anti-rebound member 8 further includes a recess 25 which has prongs 22 and 24 located at its outer periphery, and a stop wall 21, at the rearward portion of the recess 25.

As seen in FIG. 4, the second anti-rebound member 12 also includes homing cylinders 34, 35. Protrusion 36 is designed to depress the prongs 22, 24 of the first anti-rebound member 8 so that the prongs 22, 24 are resiliently deflected by the projection 36 and the protrusion 36 may slide past the prongs 22, 24 into the recess 25. Protrusion 36 locks onto intermediate rail 4 by fitting through an aperture of the generally the same shape as protrusion 36, located at the forward portion of the intermediate rail 4. Stop wall 21 prevents further movement of the protrusion 36 into the recess 25. With the protrusion 36 abutting the stop wall 21 and being held in place by the prongs 22, 24, a closed position is attained and anti-rebound members 8 and 12 resist re-opening. Anti-rebound members 8 and 12 are preferably manufactured from nylon or similar materials using conventional injection molding techniques and apparatus. In some applications it may be necessary to reinforce the nylon with fiberglass or other similar fillers depending on the desired strength and durability characteristics.

Figure 7:
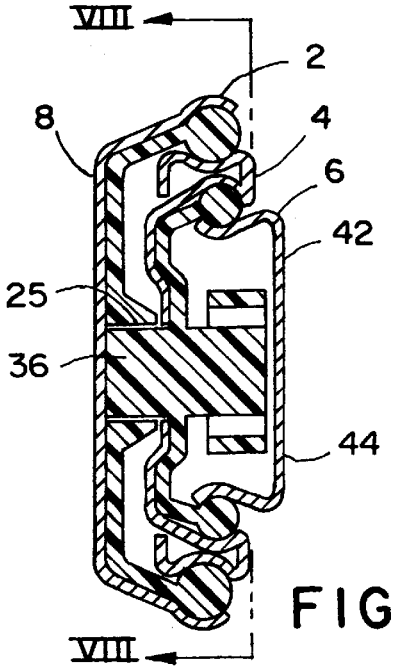
FIG. 7 a cross sectional view of the slide taken along line VII—VII in FIG. 6.
Figure 6:
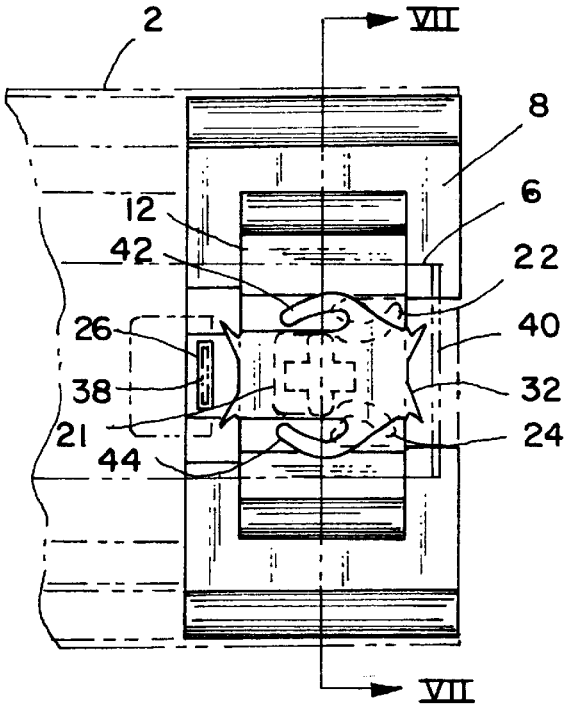
FIG. 6 a side view of the anti-rebound mechanism in the fully closed position.
Figure 8:
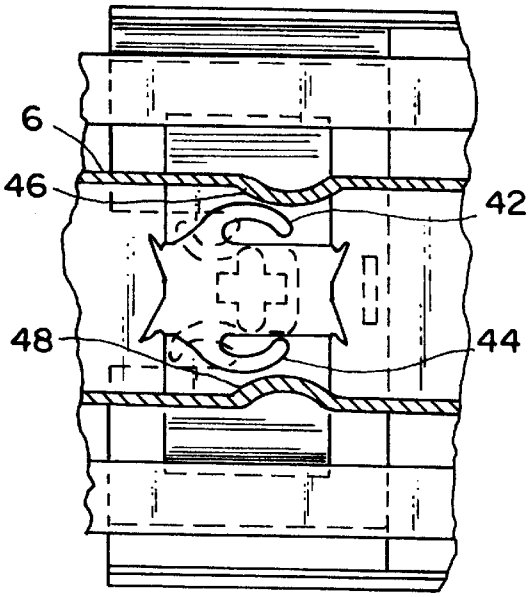
FIG. 8 is a cross sectional view of the slide taken along line VIII—VIII in FIG. 7.

In FIG. 6, prongs 22 and 24 hold the protrusion 36 of the second member 12 in place preventing it from rebounding back open. The stop wall 21 stops the rearward movement of intermediate rail 4 with respect to cabinet rail 2. Anti-rebound bumper 32 also stops the rearward motion of drawer rail 6 by interacting with stop tab 40 of the drawer rail 6. Tab 38 which is punched from cabinet rail 2 acts to hold the first anti-rebound member 8 in a fixed position relative to the cabinet rail by fitting within slot 26 in the first anti-rebound member 8. As can be seen, the cross sectional view of FIG. 7, the protrusion 36 of the second member 12 fits within the recess 25 of the first anti-rebound member 8. The drawer rail 6 is held in a locked fixed position with relation to the other two rails as depicted in FIG. 8. The prongs 42, 44, which are capable of being depressed by detents 46, 48 act to inhibit forward motion of the drawer rail 6 by preventing detents 46, 48 from moving to a position past the prongs 18 and 20.

Operation

Figure 9:
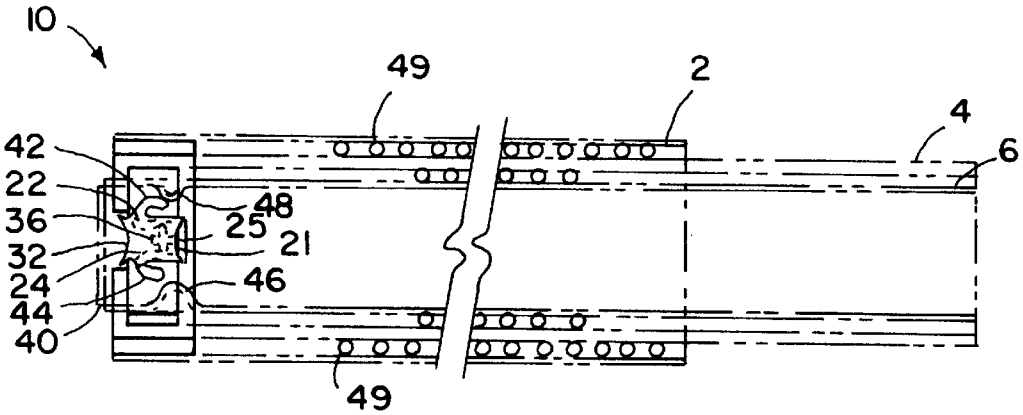
FIG. 9 is a side view of the slide in the fully closed position.
Figure 10:
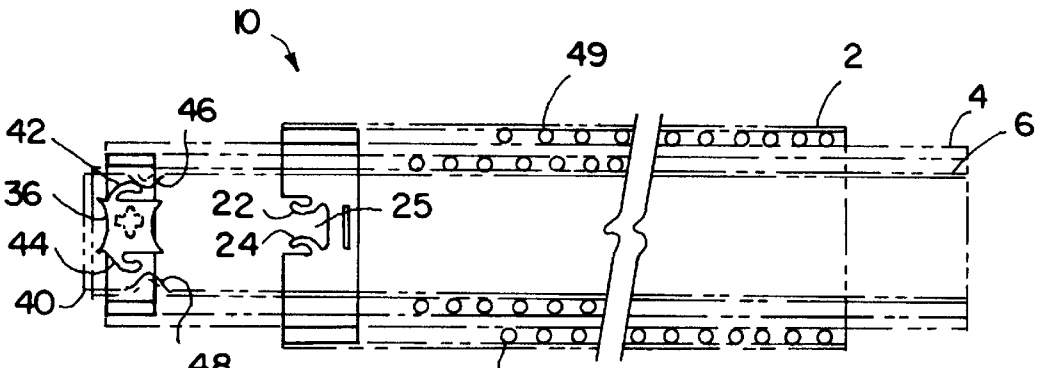
FIG. 10 is a side view of the slide with the intermediate rail partially extended from the cabinet rail.

Operation of the present invention will be described primarily in connection with FIGS. 9–12. FIG. 9 shows the rail assembly 10 with rails 4 and 6 in the closed position. In the closed position, protrusion 36 is receivedly held in recess 25 by prongs 22 and 24 and abuts stop wall 21. Assuming that the drawer has just been forcefully closed at this point, forward rebounding of rails 4 and 6 would be inhibited by the prongs 22 and 24 instantaneously locking protrusion 36 into the recess. Further, rearward motion of the rails 4 would be suspended by protrusion 36 hitting stop wall 21 at the rearward portion of the recess 25. With regard to drawer rail 6, rearward motion would be suspended when the stop tab 40 abuts against bumper 32. Closure motion would also be slowed down when detents 46 and 48 depress detent prongs 42 and 44. In this closed position, rail 6 is held in a closed position with regard to rail 4 because detents 46 and 48 are held behind prong members 42 and 44. The forward ends of rails 2,4, and 6 align in the closed position.

When the drawer is initially pulled forward, the anti-rebound protrusion 36 depresses prongs 22 and 24 and slides past them, thus leaving the recess 25. The drawer rail 6 and the intermediate rail 4 will not move with respect to each other at this point in opening the rail assembly because detent prongs 42 and 44 have not yet had enough force exerted upon them by detents 46 and 48 to allow the detents to depress them and slide past the prongs to a fully open position.

Figure 11:
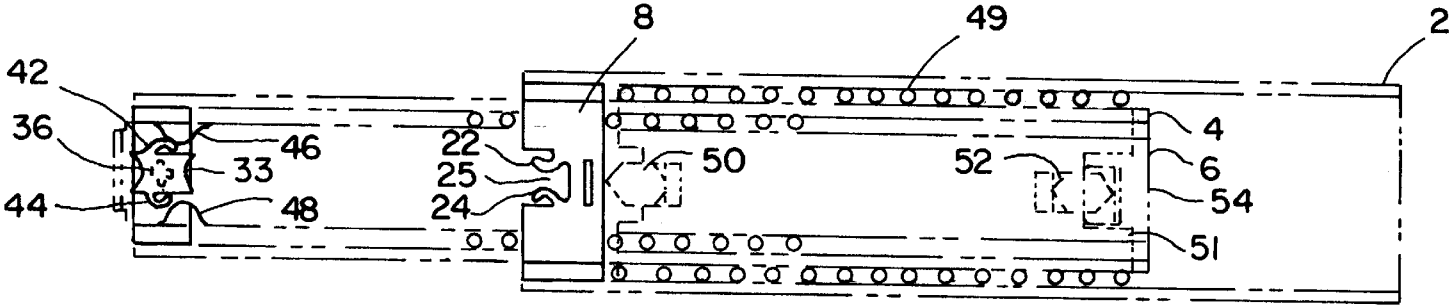
FIG. 11 is a side view of the slide with the intermediate rail fully extended from the cabinet rail.

FIG. 11 depicts the open-most position of the intermediate rail 4. Bumpers 50 and 52 are attached to a conventional bearing cage 51. When bumpers 50 and 52 come into contact with the anti-rebound member 8 and intermediate rail stop tab 54, forward motion of intermediate rail 4 is stopped.

At this point, the only rail capable of further forward movement is rail 6. As depicted in FIG. 12 when drawer rail 6 is pulled forward, detents 46 and 48 depress prongs 42 and 44 thus slide past the prongs, allowing further forward motion of drawer rail 6. This forward motion of drawer 6 continues until bumpers 55 and 56 come into contact with stop block 33 and stamped drawer rail tab 58, and completely inhibit the forward motion. At this point, the opening of drawer rail 6 stops. Closure of the drawer simply progresses in a fashion opposite that of opening the drawer, as described above.

The above description is that of a preferred embodiment of the invention. Various alterations and changes can be made without departing from the spirit and broader aspects of the invention.

The embodiments of the invention in which an exclusive privilege or property is claimed are defined as follows:

1. An interlocking anti-rebound mechanism for a rail assembly comprising:

a first member including a slot and a locking means disposed in said slot;

a first rail attached to said first member;

a second rail slidably received in said first rail;

a third rail including detents, said third rail slidably disposed in relation to said first and second rails; and, a second member attached to said second rail including a first side and a second side, said first side having an appendage for being received in said locking means, said second side having a resilient clip mechanism for lockably engaging said detents.

2. A drawer slide assembly comprising:

first, second, and third rails slidably interfitted with one another for movement between closed and extended positions, each of said rails including a forward end and a rearward end, all of said forward ends being substantially aligned with one another when said rails are in the closed position;

first and second one-piece stops fixedly secured to the forward ends of said first and second rails, respectively, said first and second stops engaging one another when said first and second rails are in the closed position to prevent said first and second rails from moving beyond the closed position from the extended position, said first and second stops cooperating to provide resistance to said first and second rails being moved out of the closed position; and said third rail including third stop means for engaging said second stop when said second and third rails are in the closed position to prevent said second and third rails from moving beyond the closed position from the extended position, said third rail further including anti-rebound means for cooperating with said second stop to providing resistance to said second and third rails being moved out of the closed position.

3. A drawer slide assembly as in claim 2, wherein said first stop includes a resilient protrusion engaging said second stop.

4. A drawer slide assembly as in claim 2, wherein said first stop is snap fitted into said first rail and said second stop is interfitted into said second rail.

5. A drawer slide assembly as in claim 4, wherein said second stop is snap fitted into said second rail.

6. A drawer slide assembly as in claim 2, wherein said third stop means includes a stop member integral with said third rail.

7. A drawer slide assembly as in claim 2, wherein said third rail includes an integral deformation engaging said second stop.

8. A drawer slide assembly as in claim 2, wherein said first stop and said second stop are made a polymer.

9. A drawer slide assembly as in claim 2, wherein said second stop includes a resilient protrusion engaging said first stop.

* * * * *